US005935381A

United States Patent [19]

Trokhan et al.

[11] Patent Number: 5,935,381

[45] Date of Patent: Aug. 10, 1999

[54] DIFFERENTIAL DENSITY CELLULOSIC STRUCTURE AND PROCESS FOR MAKING SAME

[75] Inventors: Paul Dennis Trokhan, Hamilton; Mark Ryan Richards, Middletown; Michael Gomer Stelljes, Jr., West Chester, all of Ohio

[73] Assignee: The Procter & Gamble Company, Cincinnati, Ohio

[21] Appl. No.: 08/870,535

[22] Filed: Jun. 6, 1997

[51] Int. Cl.[6] ..... D21H 11/00

[52] U.S. Cl. ..... 162/109; 162/205; 162/207; 162/117; 162/111; 34/414; 34/422

[58] Field of Search ..... 162/109, 111, 162/203, 204, 205, 206, 207, 117, 113; 428/152, 153; 34/414, 419, 421, 422

[56] References Cited

U.S. PATENT DOCUMENTS

| | | | |
|---|---|---|---|
| 3,812,000 | 5/1974 | Salvucci, Jr. et al. | 162/111 |
| 3,821,068 | 6/1974 | Shaw | 162/111 |
| 4,112,586 | 9/1978 | Lehtinen | 34/9 |
| 4,347,100 | 8/1982 | Brucato | 162/10 |
| 4,506,456 | 3/1985 | Lehtinen | 34/12 |
| 4,506,457 | 3/1985 | Lehtinen | 34/41 |
| 4,507,173 | 3/1985 | Klowak et al. | 162/112 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,622,758 | 11/1986 | Lehtinen et al. | 34/13 |
| 4,637,859 | 1/1987 | Trokhan | 162/109 |
| 4,899,461 | 2/1990 | Lehtinen | 34/13 |
| 4,932,139 | 6/1990 | Lehtinen | 34/41 |
| 4,958,444 | 9/1990 | Rautakorpi et al. | 34/71 |
| 5,277,761 | 1/1994 | Phan | 162/109 |
| 5,334,289 | 8/1994 | Trokhan et al. | 162/358.2 |
| 5,549,790 | 8/1996 | Van Phan | 162/109 |
| 5,580,423 | 12/1996 | Ampulski | 162/111 |
| 5,594,997 | 1/1997 | Lehtinen | 34/95 |
| 5,709,774 | 1/1998 | Naieni | 162/9 |
| 5,795,440 | 8/1998 | Ampulski et al. | 162/117 |
| 5,814,190 | 9/1998 | Van Phan | 162/111 |

FOREIGN PATENT DOCUMENTS

| | | |
|---|---|---|
| 0 745 717 A1 | 12/1996 | European Pat. Off. . |
| WO 98/00604 | 1/1998 | WIPO . |

*Primary Examiner*—Jose Fortuna
*Attorney, Agent, or Firm*—Vladimir Vitenberg; Larry L. Huston; E. Kelly Linman

[57] ABSTRACT

A differential density single lamina web of cellulosic fibers comprises at least two pluralities of micro-regions disposed in a non-random and repeating pattern: a first plurality of high density regions and a second plurality of low density regions. The high density regions comprise cellulosic fibers comprising fluid latent indigenous polymers (FLIP), such as hemicelluloses and lignin. The fibers of the high-density regions are FLIP-bonded, i.e., bonded together by a process of softening, flowing and immobilization of the FLIP between the cellulosic fibers of the high density regions. The process for making the web comprises the steps of providing a plurality of papermaking fibers comprising FLIP; providing a macroscopically monoplanar papermaking belt having a web-facing surface and deflection conduits; depositing the plurality of the cellulosic fibers on the papermaking belt to form a web; heating the web to a temperature sufficient to cause the FLIP contained in a first portion associated with the web-facing surface of the belt to soften; impressing the web-side surface of the belt into the web; immobilizing the flowable FLIP and creating FLIP-bonds between the fibers comprising the first portion of the web.

20 Claims, 6 Drawing Sheets

DIFFERENTIAL DENSITY CELLULOSIC STRUCTURE AND PROCESS FOR MAKING SAME

FIELD OF THE INVENTION

The present invention is related to processes for making strong, soft, absorbent cellulosic webs. More particularly, this invention is concerned with cellulosic webs having high density micro-regions and low density micro-regions, and the processes and apparatuses for making such cellulosic webs.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products. If the paper products such as paper towels, facial tissues, toilet tissues, and the like are to perform their intended tasks and to find wide acceptance, they must possess certain physical characteristics. Among the more important of these characteristics are strength, softness, and absorbency.

Strength is the ability of a paper web to retain its physical integrity during use.

Softness is the pleasing tactile sensation consumers perceive when they use the paper for its intended purposes.

Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid.

There is a well-established relationship between strength and density of the web. Therefore the efforts have been made to produce highly densified paper webs. One of such methods, known as CONDEBELT® technology, is disclosed in the U.S. Pat. No. 4,112,586 issued Sep. 12, 1978; the U.S. Pat. Nos. 4,506,456 and 4,506,457 both issued Mar. 26, 1985; U.S. Pat. No. 4,899,461 issued Feb. 13, 1990; U.S. Pat. No. 4,932,139 issued Jun. 12, 1990; U.S. Pat. No. 5,594,997 issued Jan. 21, 1997, all foregoing patents issued to Lehtinen; and U.S. Pat. No. 4,622,758 issued Nov. 18, 1986 to Lehtinen et al.; U.S. Pat. No. 4,958,444 issued Sep. 25, 1990 to Rautakorpi et al. All the foregoing patents are assigned to Valmet Corporation of Finland and incorporated by reference herein. The CONDEBELT® technology uses a pair of moving endless bands to dry the web which is pressed and moves between and in parallel with the bands. The bands have different temperatures. A thermal gradient drives water from the relatively heated side, and the water condenses into a fabric on the relatively cold side. A combination of temperature, pressure, moisture content of the web, and a residence time causes the hemicelluloses and lignin contained in the papermaking fibers of the web to soften and flow, thereby interconnecting and "welding" the papermaking fibers together.

While the CONDEBELT® technology allows production of a highly-densified strong paper suitable for packaging needs, this method is not adequate to produce a strong and—at the same time—soft paper suitable for such consumer disposable products as facial tissue, paper towel, napkins, toilet tissue, and the like. It is well known in the art that increasing the density of a paper decreases the paper's absorbency and softness characteristics.

Cellulosic structures currently made by the present assignee contain multiple micro-regions defined most typically by differences in density. The differential density cellulosic structures are created by first, an application of vacuum pressure to the wet web associated with a molding belt thereby deflecting a portion of the papermaking fibers—to generate the low density regions, and second, pressing portions of the web comprising the non-deflected papermaking fibers against a hard surface, such as a surface of a Yankee dryer drum,—to produce the high density regions. High density micro-regions of such cellulosic structures generate strength, while low density micro-regions contribute softness, bulk and absorbency.

Such differential density cellulosic structures may be produced using through-air drying papermaking belts comprising a reinforcing structure and a resinous framework, which belts are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16,1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference.

As well known in the papermaking art, typically, wood used in papermaking inherently comprises cellulose (about 45%), hemicelluloses (about 25–35%), lignin (about 21–25%) and extractives (about 2–8%). *G. A. Smook, Handbook for Pulp & Paper Technologists, TAPPI,* 4th *printing,* 1987, pages 6–7, which book is incorporated by reference herein. Hemicelluloses are polymers of hexoses (glucose, mannose, and galactose) and pentoses (xylose and arabinose). Id., at 5. Lignin is an amorphous, highly polymerized substance which comprises an outer layer of a fiber. Id., at 6. Extractives are a variety of diverse substances present in native fibers, such as resin acids, fatty acids, turpenoid compounds, and alcohols. Id. As used herein, hemicelluloses, lignin, and polymeric extractives inherently present in cellulosic fibers are defined by a generic term "fluid latent indigenous polymers" or "FLIP." Hemicelluloses, lignin, and polymeric extractives are typically a part of cellulosic fibers, but may be added independently to a plurality of papermaking cellulosic fibers, or web, if desired, as part of a papermaking process.

Traditional papermaking conditions, such as the temperature of the web and duration of the application of pressure (i. e., a residence time) during transfer of the moist web to the Yankee dryer are not adequate to cause FLIP to soften and flow in the high density regions.

Therefore, it is a purpose of the present invention to provide a novel papermaking process for making a strong, soft, and absorbent cellulosic structures comprising high density micro-regions and low density micro-regions, the high density micro-regions being formed, at least partially, by a process of softening the fluid latent indigenous polymers inherently contained in the cellulosic papermaking fibers, allowing the fluid latent indigenous polymers to flow thereby interconnecting the adjacent papermaking fibers of the high density micro-regions, and then immobilizing the fluid latent indigenous polymers in the high-density micro-regions.

It is still another object of the present invention to provide a cellulosic structure having a plurality of high density micro-regions and a plurality of low density micro-regions, the plurality of high density micro-regions comprising fluid-latent-indigenous-polymers-bonded cellulosic papermaking fibers.

SUMMARY OF THE INVENTION

A differential density single lamina web of cellulosic fibers of the present invention comprises at least two pluralities of micro-regions disposed in a non-random and repeating pattern: a first plurality of high density micro-regions and a second plurality of low density micro-regions. The high density micro-regions comprise cellulosic fibers comprising fluid latent indigenous polymers (FLIP), such as hemicelluloses, lignin, and polymeric extractives. The fibers of the high-density micro-regions are fluid-latent-indigenous-polymers-bonded (FLIP-bonded), i. e., bonded together by a process of softening, to the point of becoming flowable, and then immobilization of the FLIP between the juxtaposed and adjacent cellulosic fibers of the high density micro-regions.

In one embodiment, the high density micro-regions comprise an essentially continuous, macroscopically monoplanar and patterned network area; and the low density micro-regions comprise a plurality of discrete domes dispersed throughout, encompassed by, and isolated one from another by the network area. In another embodiment, the low density micro-regions comprise an essentially continuous and patterned network area; and the high density micro-regions comprise a plurality of discrete knuckles circumscribed by and dispersed throughout said network area.

In the process aspect of the present invention, the process for making differential density single lamina web of cellulosic fibers comprises the following steps:

providing a plurality of papermaking cellulosic fibers comprising FLIP;

providing a macroscopically monoplanar and fluid-permeable forming belt having a web-side surface, a backside surface opposite said web-side surface, and deflection conduits extending between the web-side surface and the backside surface;

depositing the plurality of the cellulosic fibers on the forming belt to form a web comprising a first portion of the cellulosic fibers associated with the web-side surface, and a second portion of the cellulosic fibers corresponding to the deflection conduits;

heating the first portion of the web for a period of time and to a temperature sufficient to cause the FLIP contained in the first portion to soften;

impressing the web-side surface of the forming belt into the web, thereby densifying the first portion of the cellulosic fibers and causing the FLIP to flow and interconnect those cellulosic fibers which are mutually juxtaposed in the first portion;

immobilizing the flowable FLIP and creating FLIP-bonds between the mutually juxtaposed cellulosic fibers in the first portion.

The step of immobilizing the flowable FLIP and creating FLIP-bonds may be accomplished by either one or combination of the following: drying at least a first portion of the web, cooling at least the first portion of the web, releasing the pressure caused by the step of impressing the web-side surface of the forming belt into the web.

The step of impressing the web-side surface of the forming belt into the web may be accomplished by pressurizing the web in association with the papermaking belt between a mutually opposed first press member having a first press surface and a second press member having a second press surface, the first and second press members being pressed toward each other. The press surfaces are parallel to each other and mutually opposed. The web and the papermaking belt are interposed between the first and second press surfaces such that the first press surface contacts the web, and the second press surface contacts the backside surface of the papermaking belt.

Preferably, the step of heating the first portion and the step of impressing are performed concurrently.

The process may further comprise the step of applying a fluid pressure differential to the web such as to leave the first portion of the cellulosic fibers on the web-side surface of the forming belt while deflecting the second portion of the cellulosic fibers into the deflection conduits, and removing a portion of the liquid carrier from the web. Preferably, the step of applying a fluid pressure differential is performed subsequently to the step of draining the liquid carrier through the forming belt and prior to the step of heating the first portion.

The process of the present invention may further utilize a macroscopically monoplanar molding belt, separate from the forming belt; then the process further comprises the step of transferring the web from the forming belt to the molding belt. In this case, the steps of applying a fluid pressure differential, heating, impressing, drying, and cooling are preferably performed while the web is in association with the molding belt.

DETAILED DESCRIPTION OF THE INVENTION

The papermaking process of the present invention comprises a number of steps or operations which occur in the general time sequence as noted below. It is to be understood, however, that the steps described below are intended to assist a reader in understanding the process of the present invention, and that the invention is not limited to processes with only a certain number or arrangement of steps. In this regard, it is noted that it is possible, and in some cases even preferable, to combine at least some of the following steps so that they are performed concurrently. Likewise, it is possible to separate at least some of the following steps into two or more steps without departing from the scope of this invention.

Figure 1:
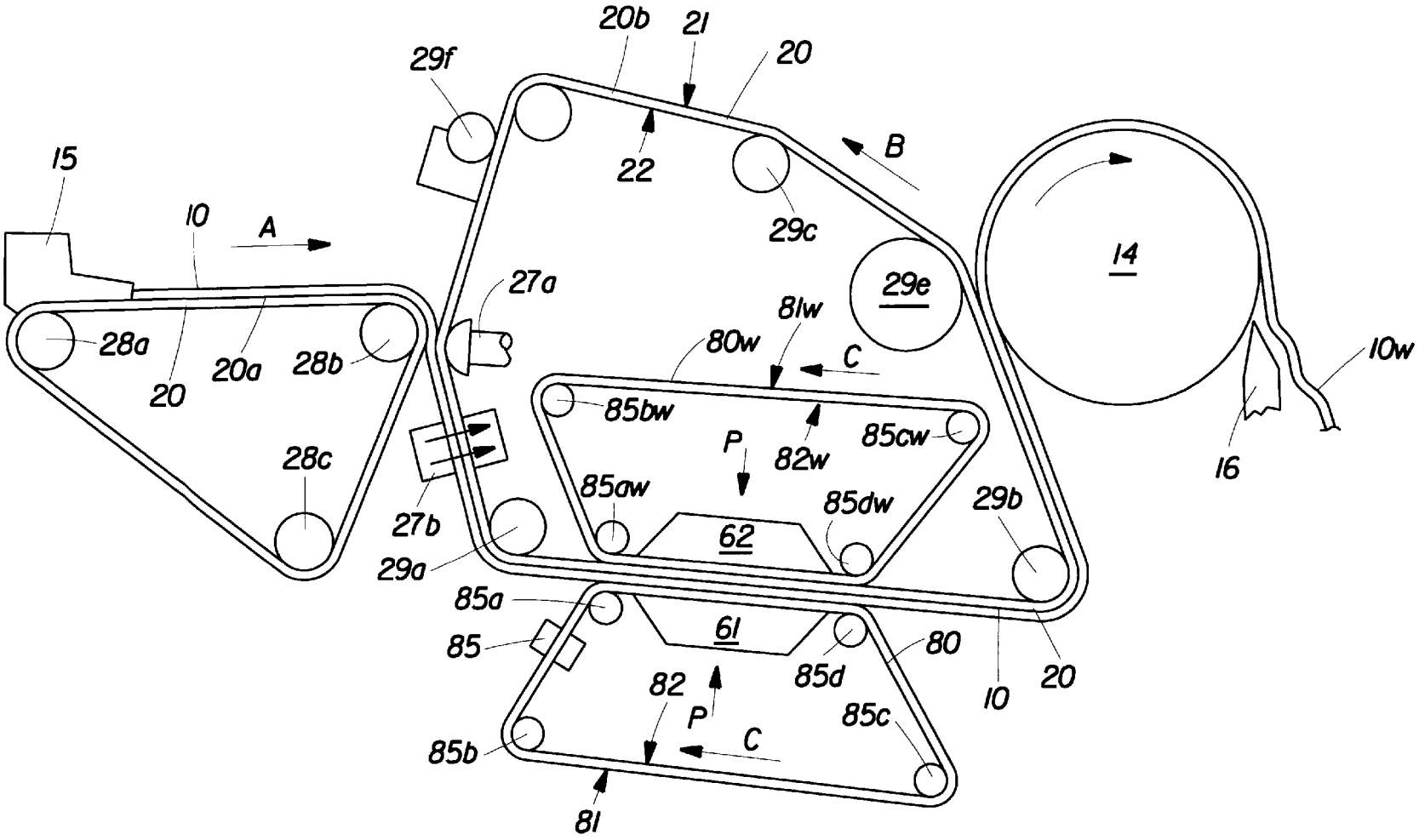
FIG. 1 is a schematic side elevational view of one exemplary embodiment of a continuous papermaking process of the present invention, showing a web being heated by a heating wire and pressurized between a pair of press members.
Figure 1A:
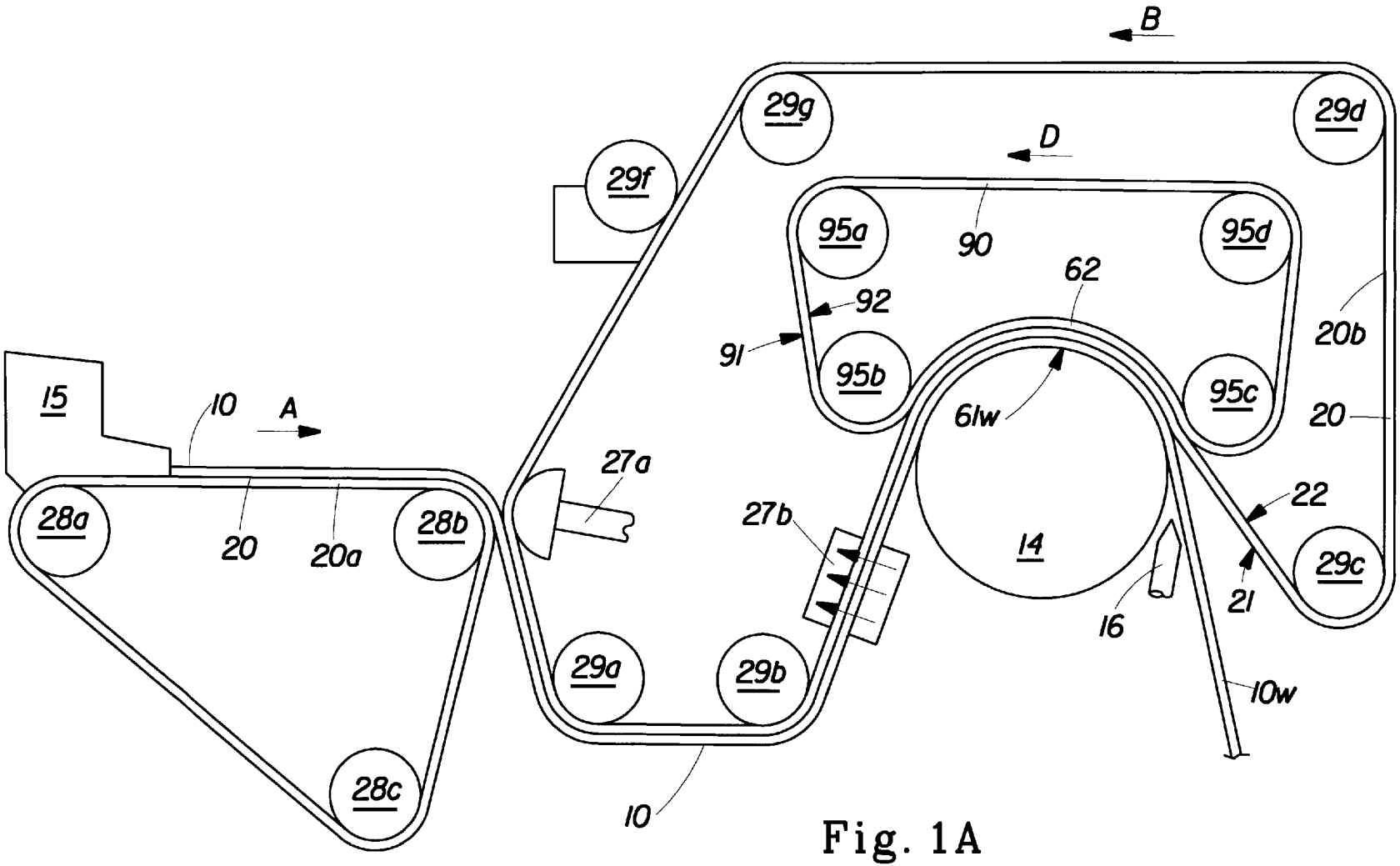
FIG. 1A is a schematic side elevational view of another exemplary embodiment of a continuous papermaking process of the present invention, showing a web being heated by a Yankee drying drum and pressurized between the Yankee drying drum and a pressing belt.

FIGS. 1 and 1A are simplified, schematic representations of two embodiments of a continuous papermaking process of the present invention. As used herein, the term "papermaking belt 20," or simply, "belt 20," is a generic term including both a forming belt 20*a* and a molding belt 20*b*, both belts shown in the preferred form of endless belt in FIGS. 1 and 2. The present invention may utilize the single papermaking belt 20 functioning as both the forming belt 20*a* and the molding belt 20*b* (this embodiment is not shown in the figures of the present invention but may easily be visualized by one skilled in the art). However, the use of the separate belts 20*a* and 20*b* is preferred. One skilled in the art will understand that the present invention may utilize more than two belts; for example, a drying belt (not shown), separate from the forming belt 20*a* and the molding belt 20*b* may be used.

As used herein, the term "X-Y plane" designates a plane parallel to the general macroscopically monoplanar plane of the papermaking belt 20, and the term "Z-direction" designates a direction perpendicular to the X-Y plane.

Figure 2:
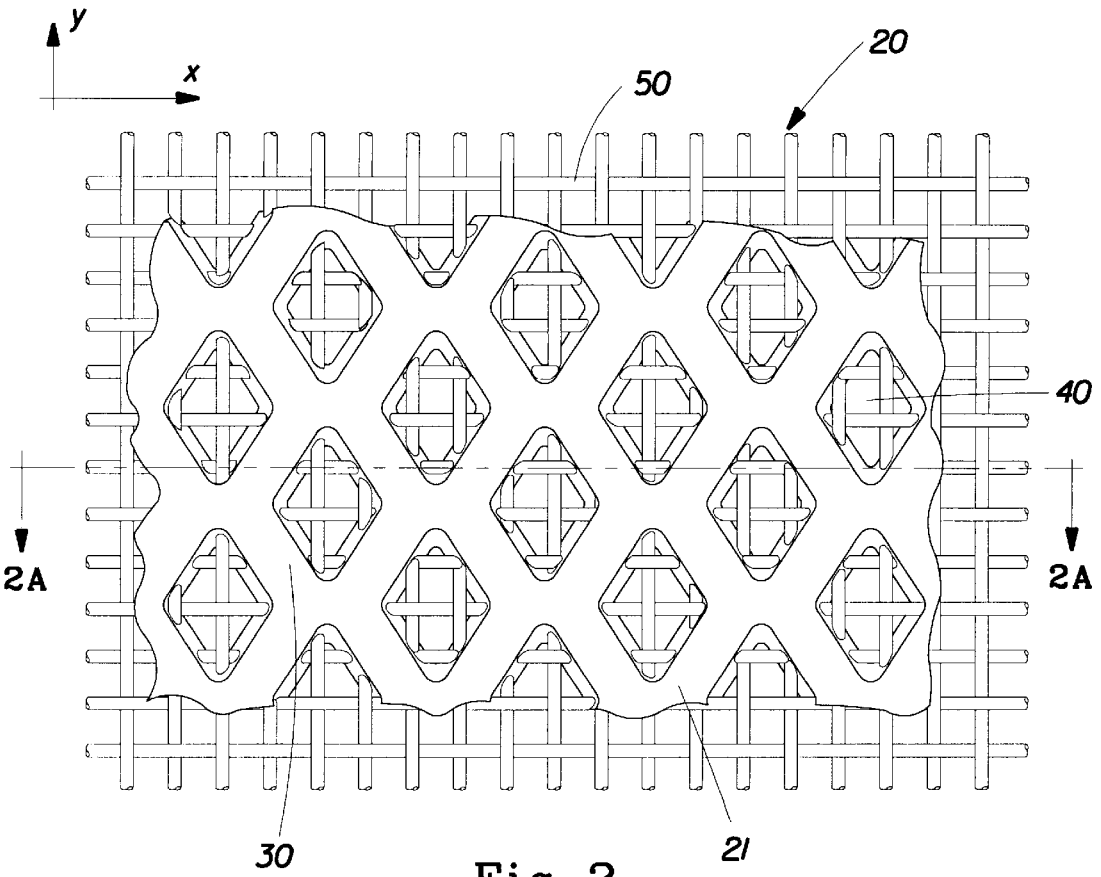
FIG. 2 is a schematic top plan view of a papermaking belt utilized in the process of the present invention, having an essentially continuous web-side network and discrete deflection conduits.

The first step of the papermaking process is to provide a plurality of cellulosic papermaking fibers, preferably suspended in a fluid carrier. More preferably, a plurality of cellulosic papermaking fibers suspended in a fluid carrier comprises an aqueous dispersion of papermaking fibers. The equipment for preparing the aqueous dispersion of papermaking fibers is well-known in the papermaking art and is therefore not shown in FIGS. 1 and 2. The aqueous dispersion of papermaking fibers is provided to a headbox 15. A single headbox is shown in FIGS. 1 and 2. However, it is to be understood that there may be multiple headboxes in alternative arrangements of the papermaking process of the present invention. The headbox(es) and the equipment for preparing the aqueous dispersion of papermaking fibers are typically of the type disclosed in U.S. Pat. No. 3,994,771, issued to Morgan and Rich on Nov. 30, 1976, which is incorporated by reference herein. The preparation of the aqueous dispersion and the characteristics of the aqueous dispersion are described in greater detail in U.S. Pat. No. 4,529,480 issued to Trokhan on Jul. 16, 1985, which is incorporated herein by reference.

As has been explained hereinabove, typically a wood pulp used in papermaking inherently comprises cellulose, hemicelluloses, lignin, and extractives. As a result of mechanical and/or chemical treatment of wood to produce pulp, portions of hemicelluloses, lignin, and extractives are removed from the papermaking fibers. It is believed that when the fibers are brought together during a papermaking process, cellulose hydroxyl groups are linked together by hydrogen bonds. Smook, infra at 8. Therefore, the removal of most of the lignin, while retaining substantial amounts of hemicelluloses, is generally viewed as a desirable occurrence, because the removal of lignin increases absorbency of the fibers. A process of "beating" or "refining" which causes removal of primary fiber walls also helps to increase fiber absorbency (Id., at 7), as well as increase fibers' flexibility. Although some portion of the fluid latent indigenous polymers, or "FLIP" as defined hereinabove, is removed from the papermaking fibers during mechanical and/or chemical treatment of the wood, the papermaking fibers still retain a portion of the FLIP even after the chemical treatment. The claimed invention allows advantageous use of those FLIP which have traditionally been viewed as undesirable in the papermaking process. Of course, hemicelluloses, lignin, and polymeric extractives may be added to the papermaking fibers or a web, if desired, during a papermaking process.

Hemicelluloses, lignin, and polymeric extractives, which are part of the papermaking fibers, are normally present in the cellulosic fibers in a non-fluid condition. However, under certain conditions defined by temperature, pressure, moisture content, the FLIP may soften and flow. The term "FLIP" reflects the common quality of these substances to normally be hardened or immobilized, and to soften and become flowable under certain imposed conditions.

In an exemplary embodiment shown in FIG. 1, the aqueous dispersion of papermaking fibers containing FLIP and supplied by the headbox 15 is delivered to the papermaking belt 20, such as the forming belt 20*a*, for carrying out the second step of the papermaking process. In FIGS. 1 and 1A, the forming belt 20*a* is supported by a breast roll 28*a* and a plurality of return rolls designated as 28*b* and 28*c*. The forming belt 20*a* is propelled in the direction indicated by the directional arrow A by a conventional drive means well known to one skilled in the art and therefore not shown in FIGS. 1 and 1A. There may also be associated with the papermaking process shown in FIGS. 1 and 1A optional auxiliary units and devices which are commonly associated with papermaking machines and with forming belts, including: forming boards, hydrofoils, vacuum boxes, tension rolls, support rolls, wire cleaning showers, and the like, which are conventional and well-known in the papermaking art, and therefore also not shown in FIGS. 1 and 1A.

Figure 3:
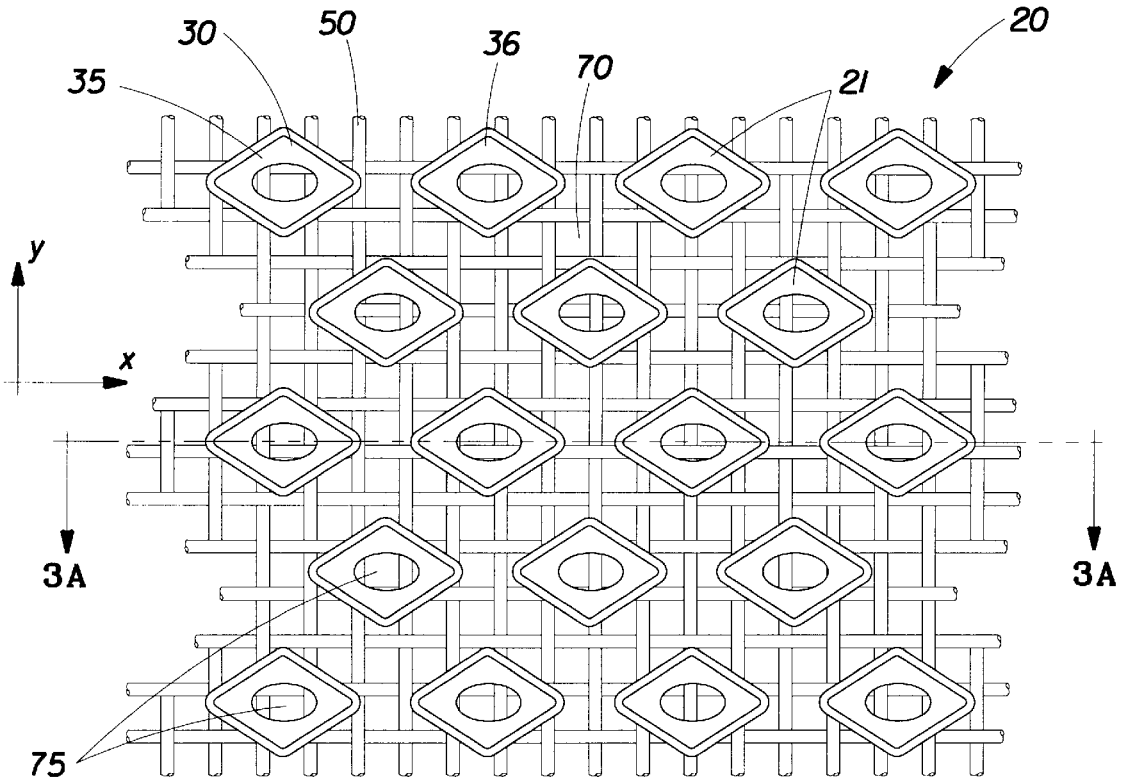
FIG. 3 is a schematic top plan view of the papermaking belt comprising a framework formed by discrete protuberances encompassed by an essentially continuous area of deflection conduits, the discrete protuberances having a plurality of discrete deflection conduits therein.
Figure 3A:
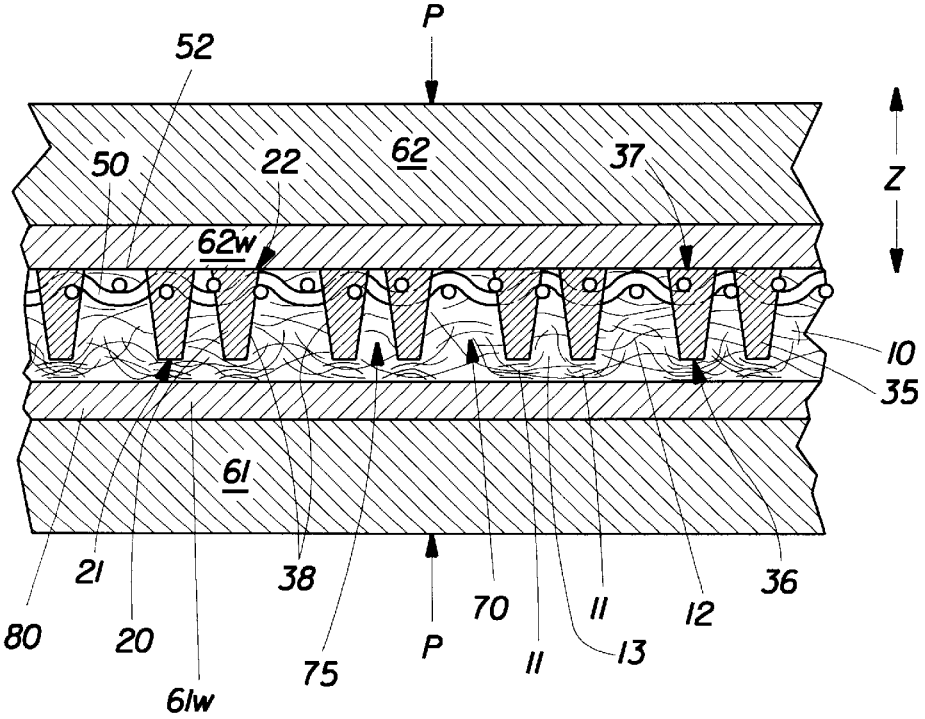
FIG. 3A is a schematic fragmentary cross-sectional view of the papermaking belt taken along lines 3A—3A of FIG. 3 and showing a cellulosic web in association with the papermaking belt being pressurized between a first press member and a second press member.

The preferred forming belt 20*a* is a macroscopically monoplanar, fluid-permeable belt. The forming belt 20*a* may comprise a forming wire well known to one skilled in the papermaking art. Referring to FIGS. 2–3A, the forming belt 20*a* may comprise an air-permeable reinforcing structure 50 and a framework 30 joined to the reinforcing structure 50. Preferably, the framework 30 is resinous. The reinforcing structure 50 has a web-facing side 51 and a machine-facing side 52 opposite to the web-facing side 51. The web-facing side 51 defines an X-Y plane of the forming belt 20*a*, the X-Y plane being perpendicular to a Z-direction. The framework 30 may comprise a plurality of discrete protuberances 35 joined to and extending from the reinforcing structure 50, as shown in FIGS. 3 and 3A. Alternatively, the framework 30 may be essentially continuous, as shown in FIG. 2.

In the forming belt 20*a* comprising the plurality of discrete protuberances 35, each of the protuberances 35 has a top surface 36, a base surface 37, and walls 38 spacing apart and interconnecting the top surface 36 and the base surface 37, as shown in FIGS. 3 and 3A. A plurality of top surfaces 36 define a web-side surface 21, and a plurality of base surfaces 37 define a backside surface 22 of the forming belt 20*a*. This type of forming belt 20*a* is disclosed in the commonly assigned U.S. Pat. No. 5,245,025 issued to Trokhan et al. on Sep. 14, 1993, and U.S. Pat. No. 5,527,428 issued to Trokhan et al. on Jun. 18,1996, all of which are incorporated by reference herein.

As shown in FIG. 3, the belt 20 comprised of the plurality of discrete protuberances 35 has essentially continuous conduits 70 extending between the web-side surface 21 and the backside surface 22 of the belt 20. In addition to the continuous conduits 70, the belt 20 may have a plurality of discrete deflection conduits 75 disposed in the protuberances 35 and also extending between the web-side surface 21 and the backside surface 22 of the forming belt 20*a*. The forming belt 20*a* comprising both the essentially continuous conduits 70 and the discrete conduits 75 has high flow rate liquid pervious zones and low flow rate liquid pervious zones respectively defined by the essentially continuous deflection conduits 70 and the discrete conduits 75. When the liquid carrier and entrained cellulosic fibers are deposited onto such forming belt 20*a*, the liquid carrier is drained through the forming belt 20*a* in two simultaneous stages, a high flow rate stage and a low flow rate stage, as described in greater detail in commonly assigned and above-referenced U.S. Pat. No. 5,245,025.

The belt 20 comprising an essentially continuous framework 30 may also be used as the forming belt 20*a*. However, this type of the belt 20 having the essentially continuous framework 30 should preferably be used as the molding belt 20*b*, as will be discussed in greater detail below. The type of the belt 20 having the essentially continuous framework 30 is disclosed in the above-referenced commonly assigned U.S. Pat. No. 5,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985, all of which are incorporated by reference herein.

One skilled in the art will understand that if the forming belt 20*a* comprises a forming wire well known in the art and therefore not shown, the surface of the forming wire contacting the web comprises the web-side surface 21 defining the X-Y plane, the opposite surface of the forming wire comprises the backside surface 22, and the void spaces between the filaments of the forming wire comprise deflection conduits extending between the web-side surface 21 and the backside surface 22 of the forming wire.

The next step is depositing the plurality of cellulosic papermaking fibers, preferably suspended in the fluid carrier, on the web-side surface 21 of the forming belt 20*a*, and preferably draining the fluid carrier through the forming belt 20*a*, to form an embryonic web 10 of the papermaking fibers on the forming belt 20*a*. As used herein, the "embryonic web" is the web of cellulosic papermaking fibers which are subjected to rearrangement on the belt 20 during the course of the papermaking process. The characteristics of the embryonic web 10 and the various possible techniques for forming the embryonic web 10 are described in the above-mentioned commonly assigned U.S. Pat. No. 4,529,480 which is incorporated by reference herein.

In the process shown in FIGS. 1 and 1A, the embryonic web 10 is formed from the cellulosic fibers suspended in the liquid carrier between breast roll 28*a* and return roll 28*b* by depositing the cellulosic fibers suspended in the liquid carrier onto the forming belt 20*a* and removing a portion of the liquid carrier through the forming belt 20*a*. Conventional vacuum boxes, forming boards, hydrofoils, and the like which are not shown in FIGS. 1 and 1A are useful in effecting the removal of liquid carrier.

For clarity and consistency, as used herein, the web 10, regardless of the stages of its processing, is referenced by the same numeral "10," i. e., "embryonic" web 10, "intermediate" web 10, "predried" web 10, and so on. The finished product—a paper web—is referenced by the numeral "10*."

Figure 2A:
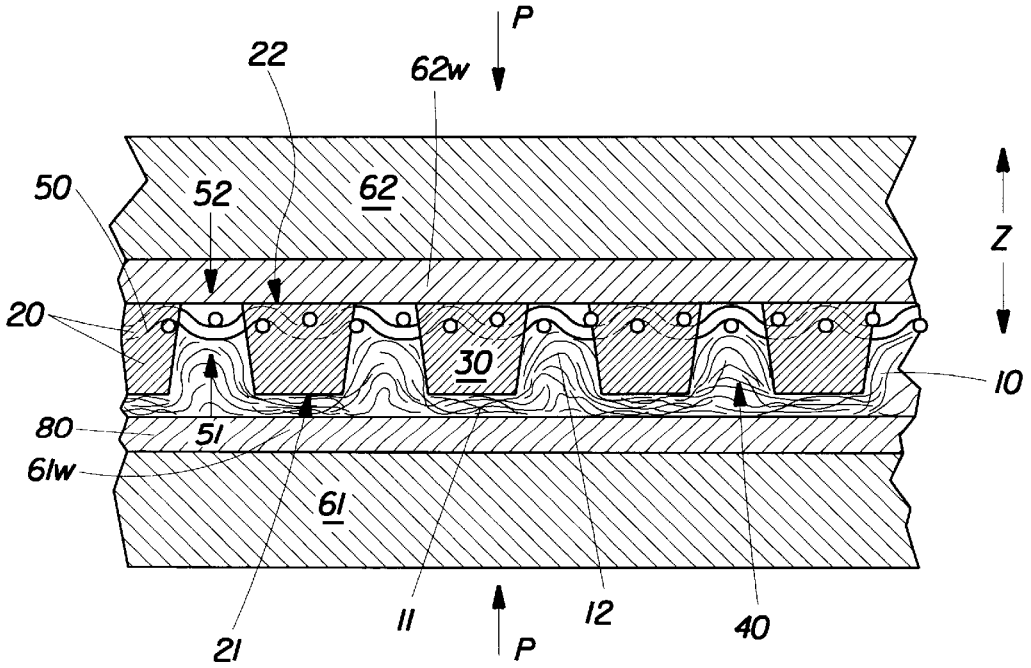
FIG. 2A is a schematic fragmentary cross-sectional view of the papermaking belt taken along lines 2A—2A of FIG. 2, and showing a cellulosic web in association with the papermaking belt being pressurized between a first press member and a second press member.

As shown in FIGS. 2A and 3A, the embryonic web 10 formed on the forming belt 20*a* comprises a first portion 11 of the cellulosic fibers and a second portion 12 of the cellulosic fibers. The first portion 11 is a portion which is physically associated with the web-side surface 21 of the belt 20, or which corresponds to the web-side surface 21 in the Z-direction. The second portion 12 is a portion which is not physically associated with the web-side surface 21 of the belt 20, or which corresponds in the Z-direction to either (1) the continuous deflection conduits 70— when the belt 20 having the framework 30 comprising the plurality of discrete protuberances 35 is utilized (FIG. 3A), or (2) the discrete deflection conduits 40—when the belt 20 having the essentially continuous framework 30 is utilized (FIG. 2A). One skilled in the art will understand that the same fiber may (and in many cases will) comprise both the first portion 11 and the second portion 12. i. e., at least one part of the fiber may correspond in the Z-direction to the web-side surface 21, while the other part or parts of the same fiber may correspond in the Z-direction to the deflection conduit or conduits.

When the forming belt 20*a* comprising the essentially continuous deflection conduits 70 is utilized, the second portion 12 of the embryonic web 10 comprises an essentially continuous and patterned network (corresponding in the Z-direction to the area of the essentially continuous conduits 70) preferably having a relatively high basis weight; and the first portion 11 of the embryonic web comprises a plurality of discrete knuckles (corresponding to the plurality of discrete protuberances 35) preferably having a relatively low basis weight. The first portion 11 comprising the plurality of discrete knuckles is circumscribed by and adjacent to the second portion 12. The first portion 11 comprising the plurality of discrete knuckles preferably occur in a non-random repeating pattern corresponding to the preferred non-random pattern of the plurality of the discrete protuberances 35 of the forming belt 20*a*.

As shown in FIGS. 3 and 3A, the forming belt 20*a* may have both the essentially continuous conduits 70 and the discrete conduits 75 disposed in the discrete protuberances 35. In the latter case, the embryonic web 10 comprises a third portion 13 preferably having an intermediate basis weight relative to the basis weight of the first portion 11 and the basis weight of the second portion 12. The third portion 13 occurs in a preferred non-random repeating pattern corresponding to the discrete conduits 75. The third portion 13 is juxtaposed with, and preferably circumscribed by, the first portion 11.

The commonly assigned U.S. Pat. No. 5,628,876 issued May 13, 1997 in the name of Ayers et al., discloses a semi-continuous pattern of the framework 23 which also can be utilized in the belt 20 for the purposes of the present invention. The foregoing patent is incorporated by reference herein.

During formation of the embryonic web 10 and after the embryonic web 10 is formed, the embryonic web 10 travels with the forming belt 20*a* in the direction indicated by the directional arrow A (FIGS. 1 and 1A) to be brought into the proximity of the molding belt 20*b*. Alternatively, the single belt 20 may be utilized as both the forming belt 20*a* and the molding belt 20*b*.

The next step is transferring the embryonic web 10 from the forming belt 20*a* to the web-side surface 21 of the molding belt 20*b*. Conventional equipment, such as vacuum pick-up shoe 27*a* (FIGS. 1 and 1A), may be utilized to accomplish the transferal. As has been pointed out above, in one embodiment of the process of the present invention, the single belt 20 may be utilized as both the forming belt 20*a* and the molding belt 20*b*. In the latter case, the step of transferal is not applicable, as one skilled in the art will readily appreciate. Also, one skilled in the art will understand that the vacuum pick-up shoe 27*a* shown in FIGS. 1 and 1A is the one preferred means of transferring the web 10 from the forming belt 20*a* to the molding belt 20*b*. Other equipment, such as intermediate belt or the like (not shown) may be utilized for the purpose of transferring the web 10 from the forming belt 20*a* to the molding belt 20*b*. The commonly assigned U.S. Pat. No. 4,440,579 issued Apr. 3, 1984 to Wells et al. is incorporated by reference herein.

The preferred molding belt 20*b* is a macroscopically monoplanar, fluid-permeable belt. One embodiment of the preferred molding belt is shown in FIGS. 2 and 2A . The molding belt 20*b* shown in FIGS. 2 and 2A preferably comprises the air-permeable reinforcing structure 50 and the essentially continuous, and preferably resinous, framework 30 joined to and extending from the reinforcing structure 50. The web-side surface 21 of the drying belt 20*b* comprises an essentially continuous web-side network defining web-side openings of the discrete deflection conduits 40, and the backside surface 22 of the molding belt 20*b* comprises a backside network defining backside openings of the conduits 40. As has been explained above, the web-side network defines the X-Y plane, and the Z-direction is a direction perpendicular to the X-Y plane.

The commonly assigned U.S. Pat. No. 4,239,065 issued Dec. 16, 1980 in the name of Trokhan and incorporated by reference herein, discloses another type of the papermaking belt 20 that can be utilized in the present invention. The foregoing belt has no resinous framework, and the web-side surface 21 of the foregoing belt is defined by co-planar crossovers distributed in a predetermined pattern throughout the belt. Another type of the belt which can be utilized as the papermaking belt 20 in the process of the present invention is disclosed in the European Patent Application having Publication Number: 0 677 612 A2, filed 12.04.95.

While in the present invention a woven element is preferred for the reinforcing structure 25 of the papermaking belt 20, a papermaking belt 20 can be made using a felt as a reinforcing structure, as set forth in U.S. Pat. No. 5,556, 509 issued Sep. 17, 1996 to Trokhan et al. and the patent applications: Ser. No. 08/391,372 filed Feb. 15, 1995 in the name of Trokhan et al. and entitled: "*Method of Applying a Curable Resin to a Substrate for Use in Papermaking*"; Ser. No. 08/461,832 filed May 5, 1995 in the name of Trokhan et al. and entitled: "*Web Patteming Apparatus Comprising a Felt Layer and a Photosensitive Resin Layer*." These patent and applications are assigned to The Procter & Gamble Company and are incorporated herein by reference.

Figure 1B:
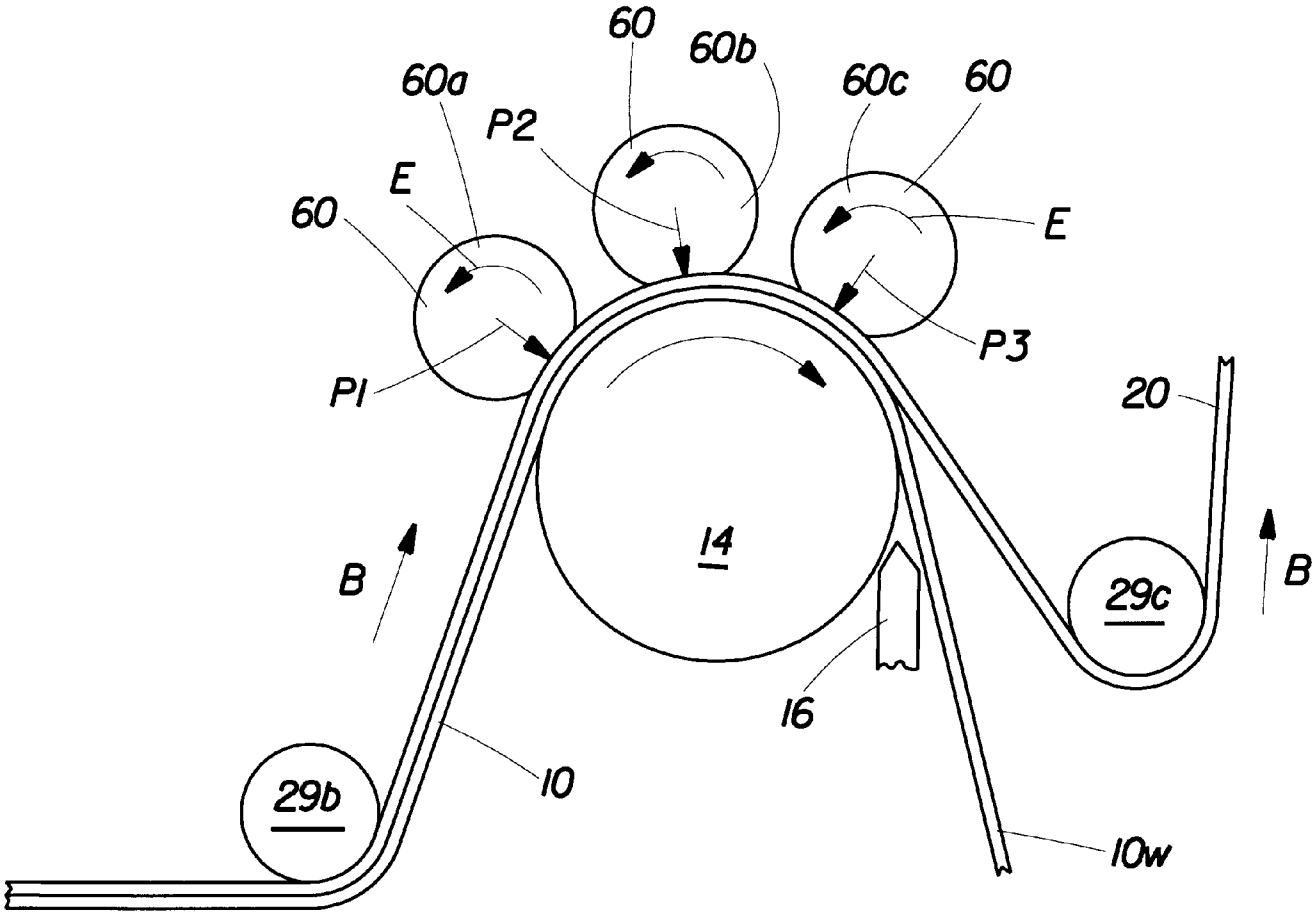
FIG. 1B is a schematic fragmental side elevational view of the process of the present invention, showing a web being pressurized between a Yankee drying drum and pressing rolls.

In the embodiments illustrated in FIGS. 1, 1A and 1B, the molding belt 20*b* travels in the direction indicated by the directional arrow B. In FIG. 1, the molding belt 20*b* passes around return rolls 29*c*, 29*d*, an impression nip roll 29*e*, return rolls 29*a*, and 29*b*. In FIG. 1A, the molding belt 20*b* passes around return rolls 29*a*, 29*b*, 29*c*, 29*d*, and 29*g*. In both FIGS. 1 and 1A, an emulsion-distributing roll 29*f* distributes an emulsion onto the molding belt 20*b* from an emulsion bath. The loop around which the molding belt 20*b* travels preferably also includes a means for applying a fluid pressure differential to the web 10, which in the preferred embodiments of the present invention comprises a vacuum pick-up shoe 27*a* and a vacuum box 27*b*. The loop may also include a pre-dryer (not shown). In addition, water showers (not shown) are preferably utilized in the papermaking process of the present invention to clean the molding belt 20*b* of any paper fibers, adhesives, and the like, which may remain attached to the molding belt 20*b* after it has traveled through the final step of the papermaking process. Associated with the molding belt 20*b*, and also not shown in FIGS. 1 and 1A, are various additional support rolls, return rolls, cleaning means, drive means, and the like commonly used in papermaking machines and all well known to those skilled in the art.

The next step is applying a fluid pressure differential to the embryonic web 10 to deflect at least a portion of the papermaking fibers into the discrete deflection conduits 40 of the molding belt 20*b* and to remove a portion of water from the embryonic web 10 thereby forming an intermediate web 10. The step of applying a fluid pressure differential is optional although highly desirable. The deflection serves to rearrange the papermaking fibers in the web 10 into the desired structure. The step of applying a fluid pressure differential to the web 10 and deflection of the fibers into the deflection conduits 40 of the molding belt 20*b*, which may be performed at the vacuum pick up shoe 27*a* and the vacuum box 27*b*, is described in greater detail in the commonly assigned U.S. Pat. No. 5,098,522 issued to Smurkoski et al on Mar. 24, 1992 and incorporated by reference herein.

The next step in the process of the present invention comprises heating the first portion 11 of the web 10, i. e., that part of the web 10 which is in association with the web-side surface 21 of the belt 20 (FIGS. 2A and 3A). It is believed that heating the first portion 11 to a sufficient temperature and for a sufficient period of time will cause the FLIP contained in the papermaking fibers of the first portion 11 to soften. Then under the pressure, the softened FLIP become flowable and capable of interconnecting those papermaking fibers which are mutually juxtaposed in the first portion 11. The step of heating the first portion 11 can be accomplished by a variety of means known in the art. For example, as schematically shown in FIG. 1, the first portion 11 may be heated by a heating wire 80. The heating wire 80 travels around return rolls 85*a*, 85*b*, 85*c*, and 85*d* in the direction indicated by the directional arrow C. The heating wire 80 is in contact with the first portion 11 of the web 10. The heating wire 80 is heated by a heating apparatus 85. Such principal arrangement is disclosed in U.S. Pat. No. 5,594,997 issued to Jukka Lehtinen on Jan. 21, 1997 and assigned to Valmet Corporation (of Finland). Alternatively or additionally, the web 10 can be heated by steam, as disclosed in U.S. Pat. No. 5,506,456 issued to Jukka Lehtinen on Mar. 26, 1985 and assigned to Valmet Corporation (of Finland). Both foregoing patents are incorporated by reference herein.

As one skilled in the art will appreciate, the molding belt 20*b* should preferably have an adequate void volume to take up a liquid displaced from the web 10. Alternatively, the molding belt 20*b* may be "backed up" by another belt that—alone or in combination with the molding belt 20*b*—does have the adequate void volume.

The application of temperature to the web 10 may be zoned (not shown). For example, in a first zone the web is fast-heated to a temperature T1 sufficient to cause the FLIP contained in the first portion 11 of the web 10 to soften and flow; and in the second zone the web 10 is merely maintained at the temperature T1. Such "zoned" application of temperature allows to better control the time during which the FLIP are in a softened and flowable condition, and may provide energy-related savings.

FIGS. 1A and 1B show embodiments of the process of the present invention, in which the step of heating is accomplished at the Yankee drying drum 14. In the embodiments shown in FIGS. 1A and 1B, the surface of the Yankee drum 14 is a heating surface.

The next step is impressing the web-side surface 21 of the belt 20 into the web 10. The step of impressing is preferably accomplished by subjecting the web 10 associated with the belt 20 and the belt 20 to a pressure between two mutually opposed press members: a first press member 61 and a second press member 62, as best shown in FIGS. 2A and 3A. The first press member 61 and the second press member 62 have a first press surface 61* and a second press surface 62*, respectively. The first and the second press surfaces 61* and 62* are parallel to the X-Y plane and mutually opposed in the Z-direction. The web 10 and the belt 20 are interposed between the first press surface 61* and the second press surface 62* such that the first press surface 61* contacts at least the first portion 11 of the web 10, and the second press surface 62* contacts the backside surface 22 of the drying belt 20*b*. Of course, in some embodiments of the process of the present invention (specifically, in the embodiments in which deflection of the papermaking fibers of the second portion 12 into the deflection conduits has not occurred) the first press surface 61* may contact both the first portion 11 and the second portion 12 of the web 10, as schematically shown in FIG. 3A.

The first press member 61 and the second press member 62 are pressed toward each other in the Z-direction (in FIGS. 2A and 3A, the pressure is schematically indicated by the directional arrows P). The first press surface 61* pressurizes the first portion 11 against the web-facing surface 21 of the belt 20 thereby densifying the first portion 11 causing the papermaking cellulosic fibers of the first portion 11 to conform to each other under the pressure P. As a result of the application of the pressure P, a resulting area of contact between the fibers of the first portion 11 increases, and the softened FLIP contained in the fibers of the first portion 11 become flowable and interconnect the adjacent and mutually juxtaposed fibers of the first portion 11.

In an alternative embodiment shown in FIGS. 1A and 1B, the step of impressing is accomplished at the Yankee drying drum 14. In this case, the surface of the Yankee drying drum 14 comprises the first press surface 61*. Under the traditional paper-making conditions, when the web 10 is transferred to the Yankee drying drum 14 using the impression nip roll 29*e* (FIG. 1), the residence time during which the web 10 is under pressure between the surface of the Yankee drum 14 and the impression roll 29*e* is too short to provide full advantage of the application of the pressure and effectively densify the fibers of the first portion 11, even if the first portion 11 contains the softened FLIP. The embodiments shown in FIGS. 1A and 1B allow to pressurize the web 10 for a much longer period of time and to receive full advantage of the softened and flowable FLIP.

In FIG. 1A, the web 10 and the molding belt 20*b* are pressurized between the surface of the Yankee dryer drum 14 and a pressing belt 90 having a first side 91 and a second side 92 opposite to the first side 91. The surface of the Yankee drum 14 comprises the first press surface 61* contacting the first portion 11 of the web 10; and the first side 91 of the pressing belt 90 comprises the second press surface 62* contacting the backside surface 21 of the molding belt 20*b*. The pressing belt 90 is preferably an endless belt schematically shown in FIG. 1A as traveling around return rolls 95*a*, 95*b*, 95*c*, and 95*d* in the direction indicated by the directional arrow D.

FIG. 1B shows a variation of the embodiment shown in FIG. 1A. In FIG. 1B, the web 10 and the molding belt 20*b* are pressurized between the surface of the Yankee drum 14 and a series of pressing rolls 60. Similarly to the embodiment shown in FIG. 1A, in the embodiment shown in FIG. 1B the surface of the Yankee drum 14 is the first press surface 61* contacting the first portion 11 of the web 10. Surfaces of pressing rolls 60 are the second press surface 62* contacting the backside surface 21 of the molding belt 20*b*. Each of the pressing rolls 60 is preferably a resilient roll elastically deformable under the pressure applied towards the surface of the Yankee drying drum 14. Each of the pressing rolls 60 is rotating in the direction indicated by the directional arrow E. Preferably, the pressure at each of the pressing rolls 60 is applied normally to the surface of the Yankee drying drum 14, i. e., towards the center of rotation of the Yankee drying drum 14.

FIG. 1B shows the second press surface 62* comprised of three consecutive pressing rolls 60 applying pressure to the backside surface 21 of the molding belt 20*b*: a first pressing roll 60*a* applying a pressure P1, a second pressing roll 60*b* applying a pressure P2, and a third pressing roll 60*c* applying a pressure P3. The use of a plurality of the pressing rolls 60 allows to apply different pressure in discrete stages (FIG. 1B), for example P1<P2<P3, or P1>P2>P3, or any other desirable combination of P1, P2, P3. One skilled in the art will understand that the number of pressing rolls 60 may differ from that shown in FIG. 1B as an illustration of one possible embodiment of the process of the present invention. Similarly to the "zoned" application of the temperature explained above, the use of a plurality of the pressing rolls 60 applying differential pressure in discrete stages enhances flexibility in optimizing the conditions that cause the FLIP to soften and flow.

Preferably, the steps of heating and pressurizing the web 10 are performed concurrently. In the latter case, the first press surface 61* preferably comprises or is associated with a heating element. In FIGS. 2A and 3A, for example, the first press surface 61* comprises the heating wire 80—in accordance with the embodiment of the process shown in FIG. 1. In FIGS. 1A and 1B, the first press surface 61* comprises the heated surface of the Yankee drying drum 14. It is believed that simultaneous pressurizing and heating of the first portion 11 of the web 10 facilitates softening and flowability of the FLIP contained in the cellulosic fibers of the first portion 11 and improves densification of the first portion 11 of the web 10.

As has been pointed out above, under the traditional papermaking conditions, when the web 10 is transferred to the Yankee drying drum 14, the residence time during which the web 10 is under pressure between the surface of the Yankee drum 14 and the impressing nip roll 29*e* (FIG. 1) is too short to effectively cause FLIP to soften. Although some densification does occur at the transfer of the web 10 to the Yankee dryer's surface at the nip between the surface of the Yankee drum 14 and the surface of the impression nip roll 29*e*, the traditional papermaking conditions do not allow to maintain the web 10 under pressure for more than about 2–5 milliseconds. At the same time, it is believed that for the purposes of causing the softened FLIP to flow and interconnect the fibers in the first portion 11, the preferred residence time should be at least about 0.1 second (100 milliseconds).

In contrast with the traditional papermaking process, the embodiments shown in FIGS. 1A and 1B allow to have a significant increase in the residence time during which the web 10 is subjected to the combination of the temperature and the pressure sufficient to cause the FLIP to become flowable and interconnect the papermaking fibers in the first (pressurized) portion 11 of the web 10. According to the process of the present invention, the more preferred residence time is greater than about 1.0 second. The most preferred residence time is in the range of between about 2 seconds and about 10 seconds. One skilled in the art will readily appreciate that at a given velocity of the papermaking belt 20, the residence time is directly proportional to the length of a path at which the web 10 is under pressure.

While the first portion 11 of the web 10 is subjected to the pressure between the first press member 61 and the web-side surface 21 of the belt 20, the second portion 12 of the web 10 is not subjected to the pressure, thereby retaining the absorbency and softness characteristics of essentially undensified web. As has been pointed out above, if the deflection of the papermaking fibers of the second portion 12 into the deflection conduits has not occurred, the first press surface 61* may contact both the first portion 11 and the second portion 12 of the web 10. Still, even in the latter case, the second portion 12 is not subjected to the pressure as the first portion 11 is, as best shown in FIGS. 2A and 3A.

Prophetically, the preferred exemplary conditions that cause FLIP to soften and become flowable as to interconnect the adjacent papermaking fibers include heating the first portion 11 of the web 10 having a moisture content of about 30% or greater (i.e., consistency of about 70% or less) to a temperature of at least 70° C. for the period of time of at least 0.5 sec. and preferably under the pressure of at least 1 bar (14.7 PSI). More preferably, the moisture content is at least about 50%, the residence time is at least about 1.0 sec., and the pressure is at least about 5 bar (73.5 PSI). If the web 10 is heated by the first press surface 61*, the preferred temperature of the first press surface 61* is at least about 150° C.

The next step involves immobilization of the flowable FLIP and creating fluid-latent-indigenous-polymers-bonds (or FLIP-bonds) between the cellulosic fibers which are softened and interconnected in the first portion 11 of the web 10. The step of immobilization of the FLIP may be accomplished by either cooling of the first portion 11 of the web 10, or drying of the first portion 11 of the web 10, or releasing the pressure to which the first portion 11 of the web 10 has been subjected. The three foregoing steps may be performed either in the alternative, or in combination, concurrently or consecutively. For example, in one embodiment of the process, the step of drying alone, or alternatively the step of cooling alone, may be sufficient to immobilize the FLIP. In another embodiment, for example, the step of cooling may be combined with the step of releasing the pressure. Of course, all three steps may be combined to be performed concurrently, or consecutively in any order.

The papermaking process of the present invention may also include an optional step of pre-drying the intermediate web 10 to form a pre-dried web 10, the step of pre-drying being performed prior to the step of heating. Any convenient means (not shown) known in the papermaking art can be used to pre-dry the intermediate web 10. For example, flow-through dryers, non-thermal, capillary dewatering devices, and Yankee dryers, alone and in combination, are satisfactory.

The next step is drying the web 10 to a consistency of greater than about 70%. Preferably the step of drying occurs when the web 10 is heated and pressed between the first and second press members 61 and 62.

The next step in the papermaking process is an optional step of foreshortening the dried web 10. As used herein, foreshortening refers to the reduction in length of a dry web 10 which occurs when energy is applied to the dry web 10 in such a way that the length of the web 10 is reduced and the fibers in the web 10 are rearranged with an accompanying disruption of some of the fiber-fiber bonds. Foreshortening can be accomplished in any of several well-known ways. The most common and preferred method is creping schematically shown in FIGS. 1, 1A, and 1B. In the creping operation, the dried web 10 is adhered to a surface and then removed from that surface with a doctor blade 16. The surface to which the web 10 is usually adhered also functions as a drying surface, typically the surface of the Yankee dryer drum 14. Generally, only the first portion 11 of the web 10 which has been associated with the web-side surface 21 of the drying belt 20 is directly adhered to the surface of Yankee dryer drum 14. The pattern of the first portion 11 of the web 10 and its orientation relative to the doctor blade 16 will in major part dictate the extent and the character of the creping imparted to a finished paper web 10*. The web 10 may also be wet-microcontracted, as disclosed in the commonly assigned U.S. Pat. No. 4,440,597 issued Apr. 3, 1984 to Wells, et al. and incorporated herein by reference.

Figure 4:
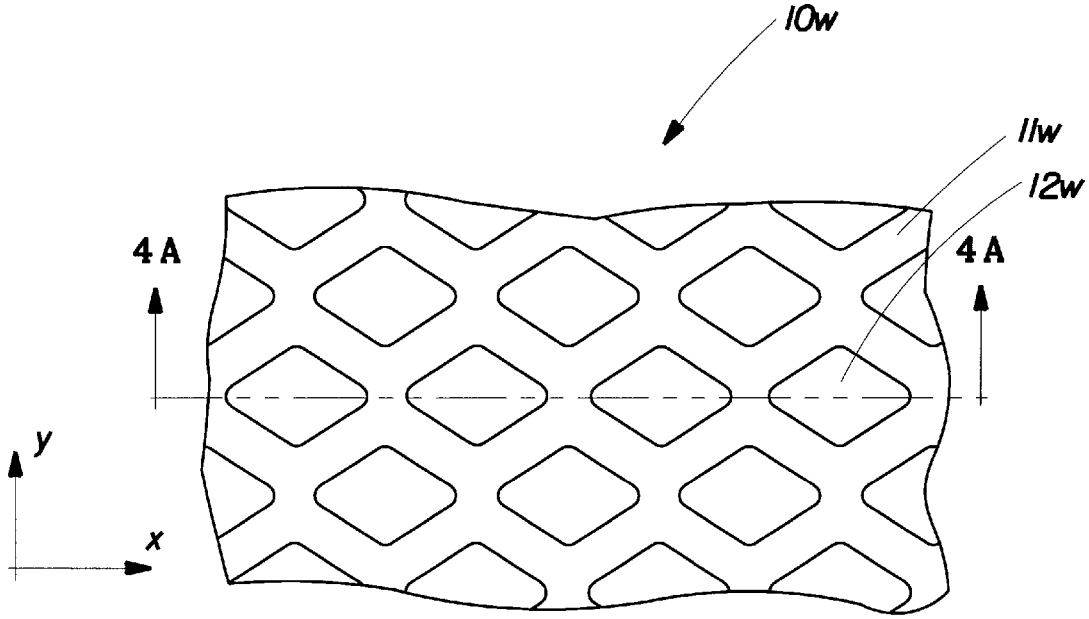
FIG. 4 is a schematic top plan view of a prophetic paper web of the present invention.
Figure 4A:
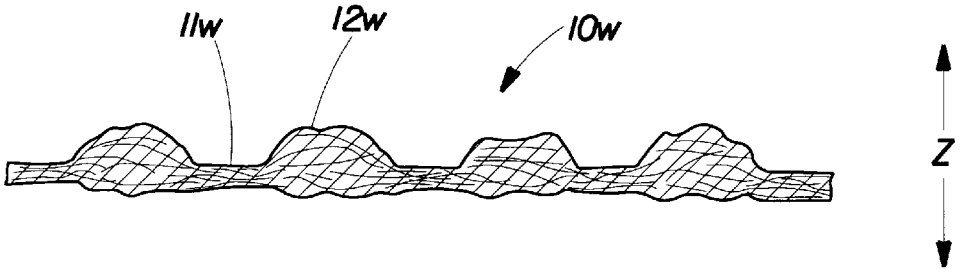
FIG. 4A is a schematic fragmentary cross-sectional view of the paper web taken along lines 4–4 of FIG. 4.

FIGS. 4 and 4A show one prophetic embodiment of the finished paper web 10* which is made by the process of the present invention utilizing the papermaking belt 20 having an essentially continuous framework 30 schematically shown in FIGS. 2 and 2A . The paper web 10* shown in FIGS. 4 and 4A comprises a first plurality of high density micro-regions and a second plurality of low density micro-regions. The high density micro-regions comprise fluid-latent-indigenous-polymers-bonded (or FLIP-bonded) cellulosic fibers. One method of determining if the FLIP-bonds have been formed is described in an article by Leena Kunnas, et al., "*The Effect of Condebelt Drying on the Structure of Fiber Bonds*," TAPPI Journal, Vol. 76, No. 4, April 1993, which article is incorporated by reference herein and attached hereto as an Appendix.

Preferably, the low density micro-regions do not contain the FLIP-bonded cellulosic fibers. The first plurality of high density micro-regions comprises an essentially continuous, macroscopically monoplanar, and patterned network area 11* (formed by the fibers of the first portion 11 of the web 10). The second plurality of low density micro-regions comprises a plurality of discrete domes 12* (formed by the fibers of the second portion 12 of the web 10). Essentially all the domes 12* are dispersed throughout, isolated one from another, and encompassed by the network area 11*. The domes 12* extend in the Z-direction from the general plane of the network area 11*. Preferably, the domes 12* are disposed in a pattern which crepeating pattern which corresponds to the pattern of the discrete conduits 40 of the resinous framework 30 of the belt 20.

A paper web made by the process of the present invention utilizing the papermaking belt 20 having the framework 30 comprising discrete protuberances 35 schematically shown in FIGS. 3 and 3A is not illustrated but can be easily visualized by imagining that in FIG. 4, the essentially continuous area designated by the reference numeral 11* is an area formed by the fibers of the second (low density) portion, and the discrete areas designated by the reference numeral 12* are areas formed by the fibers of the first (high density) portion. Then, the paper web made on the papermaking belt 20 having the framework 30 comprising the discrete protuberances 35 will have the first plurality of the high density regions comprising a plurality of discrete knuckles, and the second plurality of the low-density regions comprising an essentially continuous and patterned network area. The knuckles are circumscribed by and dispersed throughout the network area.

If the discrete protuberances 35 of the framework 30 have discrete deflection conduits 40 therein, as shown in FIG. 3, then, prophetically, the paper web will further comprise a third plurality of micro-regions corresponding to the discrete conduits 40 and formed by the fibers of the third portion 13 (FIG. 3A). The third plurality of micro-regions will comprise low density regions, essentially all of which are juxtaposed with and isolated one from another by the first plurality of high density regions.

What is claimed is:

1. A process for making a differential density single lamina cellulosic web comprising at least a first plurality of high density micro-regions and a second plurality of low density micro-regions, said process comprising the steps of:

(a) providing a plurality of papermaking cellulosic fibers comprising fluid latent indigenous polymers;

(b) providing a macroscopically monoplanar and fluid-permeable papermaking belt having a web-side surface defining an X–Y plane, a backside surface opposite said web-side surface, a Z-direction perpendicular to said X–Y plane, and deflection conduits extending between said web-side surface and said backside surface;

(c) depositing said plurality of cellulosic fibers comprising fluid latent indigenous polymers on said web-side surface of said papermaking belt to form a web of said cellulosic fibers on said papermaking belt, said web comprising at least a first portion corresponding to said web-side surface in said Z-direction, and a second portion corresponding to said deflection conduits in said Z-direction;

(d) heating at least said first portion of said web to cause said fluid latent indigenous polymers contained in cellulosic fibers of said first portion to soften;

(e) impressing said web-side surface of said papermaking belt into said web under pressure, thereby densifying said first portion of said web and causing said fluid latent indigenous polymers to flow and interconnect said cellulosic fibers which are mutually juxtaposed in said first portion; and (f) immobilizing said flowable fluid latent indigenous polymers and creating fluid-latent-indigenous-polymers-bonds between said cellulosic fibers which are interconnected in said first portion.

2. The process according to claim 1, wherein said step of immobilizing said flowable fluid latent indigenous polymers and creating said fluid-latent-indigenous-polymers-bonds comprises drying at least said first portion of said web.

3. The process according to claim 1, wherein said step of immobilizing said flowable fluid latent indigenous polymers and creating said fluid-latent-indigenous-polymers-bonds comprises cooling at least said first portion of said web.

4. The process according to claim 1, wherein said step of immobilizing said flowable fluid latent indigenous polymers and creating said fluid-latent-indigenous-polymers-bonds comprises releasing said first portion of said web from said pressure.

5. The process according to claim 1, wherein said step of immobilizing said flowable fluid latent indigenous polymers and creating said fluid-latent-indigenous-polymers-bonds comprises drying said web to a consistency of at least about 70% at a temperature less than about 70° C.

6. The process according to claim 1, wherein said step of impressing said web-side surface of said papermaking belt into said web comprises pressurizing said web and said papermaking belt between a first press member and a second press member opposite said first press member, said first and second press members having a first press surface and a second press surface, respectively, said first and second press surfaces being parallel to said X–Y plane and mutually opposed in said Z-direction, said web and said papermaking belt being interposed between said first and second press surfaces, said first press surface contacting said web, and said second press surface contacting said backside surface of said papermaking belt, said first and second press members being pressed toward each other in said Z-direction.

7. The process according to claim 6, wherein said first press surface comprises a pressing belt.

8. The process according to claim 6, wherein said first press surface comprises a surface of a Yankee drying drum.

9. The process according to claim 6, wherein said fluid latent indigenous polymers comprise hemicelluloses.

10. The process according to claim 1 or 9, wherein said fluid latent indigenous polymers comprise lignin.

11. The process according to claim 1, further comprising the step of applying a fluid pressure differential to said web of said cellulosic fibers such as to leave said first portion of said web on said web-side surface of said papermaking belt while deflecting said second portion of said web into said deflection conduits, thereby removing a portion of said liquid carrier from said web, said step of applying a fluid pressure differential to said web being performed subsequently to step (c) and prior to step (d).

12. The process according to claim 1 or 11, wherein said papermaking belt comprises a fluid-permeable reinforcing structure having a web-facing side substantially parallel to said X–Y plane, and a machine-facing side opposite said web-facing side; and a resinous framework comprised of a plurality of discrete protuberances joined to and extending from said reinforcing structure, each of said protuberances having a top surface, a base surface opposite said top surface, and walls spacing apart and interconnecting said top surface and said base surface, a plurality of said top surfaces defining said web-side surface of said papermaking belt, and a plurality of said base surfaces defining said backside surface of said papermaking belt.

13. A process for making a differential density single lamina cellulosic web comprising at least a first plurality of high density micro-regions and a second plurality of low density micro-regions, said process comprising the steps of:

(a) providing a plurality of papermaking cellulosic fibers comprising fluid latent indigenous polymers;

(b) providing a forming belt;

(c) depositing said plurality of cellulosic fibers comprising fluid latent indigenous polymers on said forming belt to form a web of said cellulosic fibers on said forming belt;

(d) providing a macroscopically monoplanar molding belt having a web-side surface defining an X–Y plane, a backside surface opposite said web-side surface, a Z-direction perpendicular to said X–Y plane, and deflection conduits extending between said web-side surface and said backside surface;

(e) transferring said web of said cellulosic fibers to said web-side surface of said molding belt, said web comprising a first portion corresponding to said web-side surface in said Z-direction, and a second portion of said cellulosic fibers corresponding to said deflection conduits in said Z-direction;

(f) heating at least said first portion of said web to cause said fluid latent indigenous polymers to soften in said first portion;

(g) impressing said web-side surface of said molding belt into said web under pressure, thereby densifying said first portion of said web and causing said fluid latent indigenous polymers to flow and interconnect said cellulosic fibers which are mutually juxtaposed in said first portion; and (h) immobilizing said flowable fluid latent indigenous polymers and creating fluid-latent-indigenous-polymers-bonds between said cellulosic fibers which are interconnected in said first portion.

14. The process according to claim 13, wherein said step of immobilizing said flowable fluid latent indigenous polymers and creating said fluid-latent-indigenous-polymers-bonds comprises drying at least said first portion of said web.

15. The process according to claim 13, wherein said step of immobilizing said flowable fluid latent indigenous polymers and creating said fluid-latent-indigenous-polymers-bonds comprises cooling at least said first portion of said web.

16. The process according to claim 13, wherein said step of immobilizing said flowable fluid latent indigenous polymers and creating said fluid-latent-indigenous-polymers-bonds comprises releasing said first portion of said web from said pressure.

17. The process according to claim 13, wherein said step of immobilizing said flowable fluid latent indigenous polymers and creating said fluid-latent-indigenous-polymers-bonds comprises drying said web to a consistency of at least about 70% at a temperature less than about 70° C.

18. The process according to claim 13, further comprising the step of applying a fluid pressure differential to said web of said cellulosic fibers such as to leave said first portion of said web on said web-side surface of said molding belt while deflecting said second portion of said web into said deflection conduits of said molding belt, thereby removing a portion of said liquid carrier from said web, said step of applying a fluid pressure differential to said web being performed subsequently to step (e) and prior to step (f).

19. The process according to claim 13 or 18 wherein said molding belt comprises a resinous framework joined to a fluid-permeable reinforcing structure, said resinous framework having a first side and a second side opposite said first side, said first and second sides defining said web-side and backside surfaces of said molding belt, respectively, said reinforcing structure positioned between said web-side and backside surfaces.

20. The process according to claim 19, wherein said web-side surface of said molding belt comprises an essentially continuous web-side network, said web-side network defining web-side openings of said deflection conduits, and said backside surface of said molding belt comprises a backside network, said backside network defining backside openings of said deflection conduits.

* * * * *